US010322851B2

(12) United States Patent
Tan

(10) Patent No.: US 10,322,851 B2
(45) Date of Patent: Jun. 18, 2019

(54) SELF-SUPPORTING PLASTIC BAG AND METHOD FOR MANUFACTURING SAME

(71) Applicant: Ah Moi Tan, Johor (MY)

(72) Inventor: Ah Moi Tan, Johor (MY)

( * ) Notice: Subject to any disclaimer, the term of this patent is extended or adjusted under 35 U.S.C. 154(b) by 0 days.

(21) Appl. No.: 15/379,440

(22) Filed: Dec. 14, 2016

(65) Prior Publication Data

US 2018/0162599 A1 Jun. 14, 2018

(51) Int. Cl.

| | |
|---|---|
| ***B65D 30/20*** | (2006.01) |
| ***B65D 30/00*** | (2006.01) |
| ***B31B 50/16*** | (2017.01) |
| ***B31B 50/26*** | (2017.01) |
| ***B31B 50/86*** | (2017.01) |
| ***B31B 70/74*** | (2017.01) |
| *B31B 160/20* | (2017.01) |

(52) U.S. Cl.
CPC ..... *B65D 31/10* (2013.01); *B31B 50/16* (2017.08); *B31B 50/26* (2017.08); *B31B 50/86* (2017.08); *B31B 70/74* (2017.08); *B65D 31/005* (2013.01); *B31B 2160/20* (2017.08)

(58) Field of Classification Search
CPC ..... B65D 31/08; B65D 33/08; B65D 33/12; B65D 31/10; B65D 31/005
USPC ..... 383/104, 122, 10, 120, 121
See application file for complete search history.

(56) References Cited

U.S. PATENT DOCUMENTS 2,041,227 A * 5/1936 Walker ..... B65D 65/10 229/87.01
2,100,739 A * 11/1937 Giifillan ..... B31B 50/00 383/106
2,169,638 A * 8/1939 Gilfillan ..... B65D 75/38 118/212
2,259,886 A * 10/1941 Irving ..... B29C 67/00 229/5.83
2,821,337 A * 1/1958 Morgan, Jr. ..... B65D 31/005 383/107

(Continued)

FOREIGN PATENT DOCUMENTS

WO 2004-052729 A2 6/2004

OTHER PUBLICATIONS

Aug. 28, 2017, PCT International Search Report in related international application PCT/IB2017/000037.

(Continued)

*Primary Examiner* — Jes F Pascua
(74) *Attorney, Agent, or Firm* — Mei & Mark LLP

(57) ABSTRACT

A plastic bag is provided. The bag may include a rectangular bottom with first, second, third, and fourth edges. It may include a first side extending from a first edge of the bottom, a second side extending from a second edge of the bottom, a third side extending from a third edge of the bottom, and a fourth side extending from a fourth edge of the bottom. The first side may have a first vertical seam and a first flap set. The third side may have a second vertical seam and a second flap set. The bottom, the first side, the second side, the third side, and fourth side are integrally formed from a single sheet of a plastic material. The first vertical seam may extend from a top of the first side to at least the first flap set. The second vertical seam may extend from a top of the third side to at least the second flap set. A method of manufacture thereof is also provided.

22 Claims, 7 Drawing Sheets

(56) References Cited

U.S. PATENT DOCUMENTS 2,942,529 A * 6/1960 Piazze ..... B31B 50/00 270/52.09
3,059,547 A * 10/1962 Piazze ..... B31B 50/00 493/206
3,136,475 A * 6/1964 Geimer ..... B65D 31/08 383/122
3,380,646 A * 4/1968 Doyen ..... B29C 65/04 383/104
3,435,736 A * 4/1969 Reiche ..... B65D 31/08 383/103
3,618,478 A * 11/1971 Piazze ..... B31B 70/00 383/119
3,750,937 A * 8/1973 Goodwin ..... B65D 31/00 383/122
4,041,851 A 8/1977 Jentsch
4,184,413 A * 1/1980 Langen ..... B65D 31/005 493/228
4,189,089 A * 2/1980 Langen ..... B65D 31/005 383/107
4,221,321 A * 9/1980 Langen ..... B65D 33/065 383/10
4,226,172 A * 10/1980 Langen ..... B65D 31/08 493/235
4,704,731 A * 11/1987 Katase ..... B65D 5/60 383/120
4,717,262 A * 1/1988 Roen ..... B65D 31/08 383/104
4,848,930 A * 7/1989 Williams ..... B65D 31/00 383/10
5,006,186 A * 4/1991 Yokoyama ..... B31B 70/00 156/211
5,580,173 A 12/1996 Sebastian
5,772,332 A * 6/1998 Geller ..... B29C 65/18 220/9.1
6,007,467 A * 12/1999 Becker ..... B65D 5/3685 493/906
6,120,183 A 9/2000 Buchanan
6,942,100 B2 5/2005 Su
7,153,026 B2 * 12/2006 Galomb ..... A01M 9/0053 383/122
7,175,583 B2 2/2007 Su
8,061,900 B1 * 11/2011 Bierschenk ..... B65D 77/02 206/526
8,267,580 B2 * 9/2012 Schneider ..... B65D 33/08 383/10
2007/0189640 A1 * 8/2007 Linton ..... B65D 31/12 383/38
2012/0230611 A1 9/2012 Ebner
2016/0090212 A1 * 3/2016 Lin ..... B65D 31/005 383/10

OTHER PUBLICATIONS

Aug. 28, 2017, Written Opinion in the ISA of in related international application PCT/IB2017/000037.
"CVS Bag" (photos and Apr. 11, 2018 IDS discussing discovery of bag).

* cited by examiner

SELF-SUPPORTING PLASTIC BAG AND METHOD FOR MANUFACTURING SAME

TECHNICAL FIELD

This application relates to bags, and methods of manufacture thereof. More specifically, it pertains to plastic bags with a rectangular bottom and that are formed from a single sheet of plastic using side-seams.

BACKGROUND

Existing plastic bags with rectangular bottoms are easier to load with groceries or other items by virtue of the way that they rest on a surface. However, this convenience comes at a price. Such rectangular-bottom plastic bags are often composed of multiple pieces of plastic, require complicated cutting and sealing, and/or are sealed on their bottom surface. Such characteristics may make manufacturing more complicated, more expensive, and less reliable. Further, additional seams cuts may make reduce the load a bag can safely.

SUMMARY

The present disclosure provides a description of plastic bags to address the perceived need described above, and methods of manufacturing the same.

In one embodiment, a plastic bag is provided. The plastic bag may include a rectangular bottom with first, second, third, and fourth edges. It may include a first side extending from a first edge of the bottom, a second side extending from a second edge of the bottom, a third side extending from a third edge of the bottom, and a fourth side extending from a fourth edge of the bottom. The first side may have a first vertical seam and a first flap set. The third side may have a second vertical seam and a second flap set. The bottom, the first side, the second side, the third side, and fourth side are integrally formed from a single sheet of a plastic material. The first vertical seam may extend from a top of the first side to at least the first flap set. The second vertical seam may extend from a top of the third side to at least the second flap set.

The first side may be parallel to and the same size as the third side. The second side may be parallel to and the same size as the fourth side. The first side may connect with and may be perpendicular to both the second side and the fourth side. The bag may be self-supporting when open. The bag may include a hem at a mouth of the bag. The width of the first side may be shorter than the width of the second side. The second and fourth sides may lack seams. The bottom may lack seams along its second and fourth edges.

The bag may include a pair of handles. The handles may be holes in the plastic sheet and, further, may be holes in the hem. The handles may be strips of plastic attached to the plastic sheet and, further, may be attached to the hem.

In another embodiment, the first vertical seam may extend from the top of the first side to the first edge of the bottom and the second vertical seam may extend from a top of the third side to the third edge of the bottom.

The first flap set may include a first flap extending from the first edge of the bottom. The second flap set may include a second flap extending from the third edge of the bottom. The first vertical seam may bisect the first flap and secure it to the first side. The second vertical seam may bisect the second flap and secure it to the third side.

The bag may further include a first flap seam and a second flap seam. The first flap seam may be parallel to the first edge of the bottom and may further secure the first flap to the first side. The second flap may be parallel to the third edge of the bottom seam and may further secure the second flap to the third side.

There distance between the first flap seam and the first edge of the bottom may be between 0.2 and 2 cm, may be between 2 and 3.5 cm, or may be between 3.5 and 6 cm.

In yet another embodiment, the first flap set may include a first flap and a second flap. The first and second flap may have the same shape.

The first flap may be connected to the first side by a horizontal flap seam and a diagonal flap seam.

The first and second flaps are shaped as right triangles or trapezoids. A diagonal edge of the first flap, a diagonal edge of the second flap, and the first edge of the bottom may a triangular area of the first side. The triangular area of the first side may be seamless.

In yet another embodiment, a method of manufacturing a plastic bag is provided. It includes cutting a rectangular sheet of plastic, folding the rectangular sheet in half at a fold, forming a first vertical seam on a first side of the folded plastic sheet while providing a first gap along a portion of the first side that is adjacent to the fold, forming a second vertical seam on a second side of the folded plastic sheet while providing a second gap along a portion of the second side that is adjacent to the fold, pushing a portion of the plastic sheet surrounding the first gap into a space at least partially enclosed by the folded rectangular sheet, and pushing a portion of the plastic sheet surrounding the second gap into the space at least partially enclosed by the folded rectangular sheet. It further includes molding and creasing the plastic sheet to form and delineate flaps, a bottom of the bag, and sides of the bag; and securing the flaps to sides of the bag.

In yet another embodiment, another method of manufacturing a plastic bag is provided. The method includes cutting a rectangular sheet of plastic, folding the rectangular sheet such that its cross-section resembles a "W" shape, forming a first vertical seam on an entirety of a first side of the folded plastic bag that includes a folded portion of the rectangular sheet, and forming a second vertical seam on an entirety of a second side of the folded plastic bag that includes the folded portion of the rectangular sheet.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments and aspects of the apparatuses and methods described herein and, together with the description, serve to explain the principles of the invention.

DETAILED DESCRIPTION

Figure 1A:
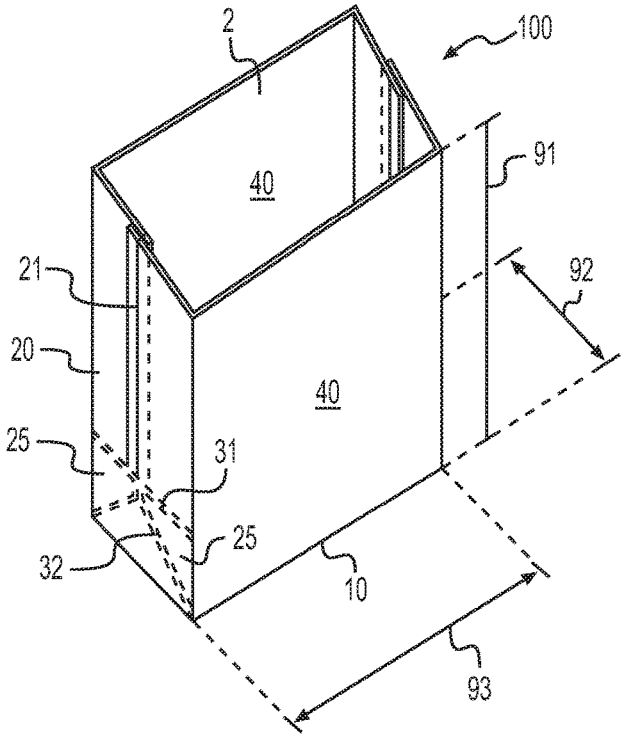
FIGS. 1A to 2C are perspective views of various examples of a self-supporting plastic bag, consistent with disclosed embodiments.

FIGS. 1A-2C illustrate various versions of bag 100. Each bag may be formed of a single plastic sheet 1. In preferred embodiments, the plastic sheet may comprise or consist of polyethelene, such as HDPE, LLDPE, LDPE or MDPE, but other suitable plastics or flexible materials known in the art may also be used.

Each bag 100 may comprise a mouth 2 at the top, a rectangular bottom 10, two seamed sides 20, and two other sides 40. The two seamed sides 20 may be parallel to one another and extend from two opposite edges of the rectangular bottom 10. The two other sides 40 may be parallel to one another and extend from the remaining two opposite edges of the rectangular bottom 10. The two seamed sides 40 may be perpendicular to the two other sides 40, respectively.

The two seamed sides 20 may be of the same size, with dimensions of bag height 91 by seamed side width 92. Similarly, the two other sides 40 may be of the same size, with dimensions of bag height 91 by other side width 93. As shown, other side width 93 may be greater than seamed side width 92 such that seamed sides 20 are of a smaller size than other sides 40. However, in alternative embodiments, other side width 93 may be shorter than seamed side width 92 or widths 93 and 92 may be the same size.

The terms "parallel," "perpendicular," "same size," "rectangular," "same shape," "right triangle," "right angle," and the like, as used above and herein, shall be understood to include minor variations as to account for manufacturing tolerances. For example, "parallel" sides need not be strictly parallel in the mathematic sense, but may be deemed sufficiently parallel where bag 100 is roughly a rectangular prism shape, when bag 100 is fully opened and straightened.

Figure 1B:
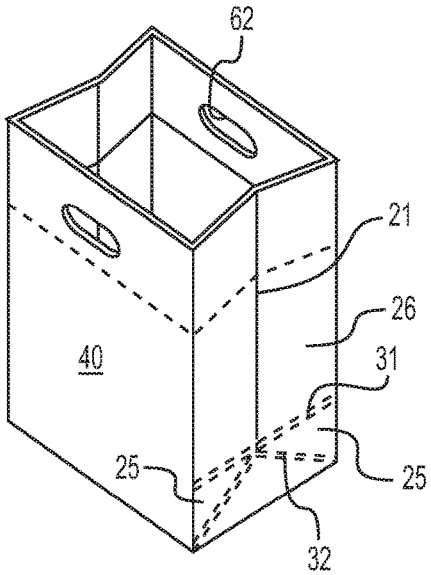
Figure 1C:
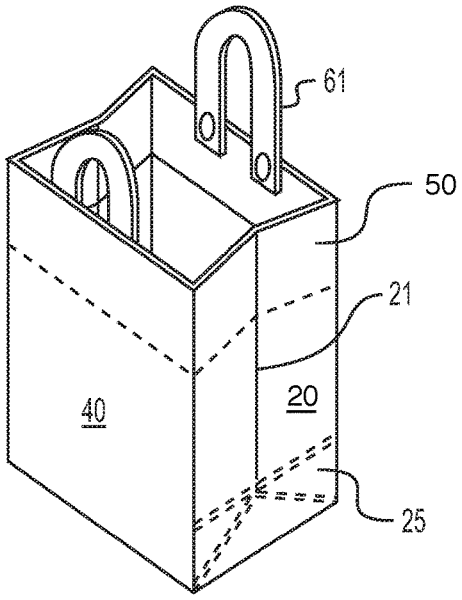

Bag 100 may further include a hem 50 at the top along mouth 2, as depicted in FIGS. 1B and 1C. Hem 50 may comprise two layers of plastic sheet 1 folded over and seamed together.

Figure 2A:
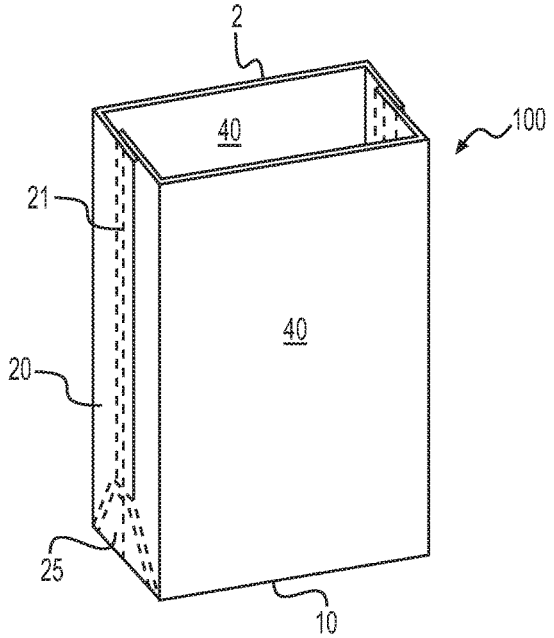

Bag 100 may be provided with a pair of handles to improve usability. As shown in FIGS. 1B and 2C, bag 100 may comprise cut handles 62. Cut handles 62 may be provided as holes cut, punched, or melted into each of other sides 40 (as shown) or, alternatively, each of seamed sides 20. Cut handles 62 may be provided entirely or partially within hem 50 in some embodiments, as depicted in FIG. 1B. Further, in some embodiments, edges of cut handles 62 may be formed of seams made in plastic sheet 1.

Figure 2B:
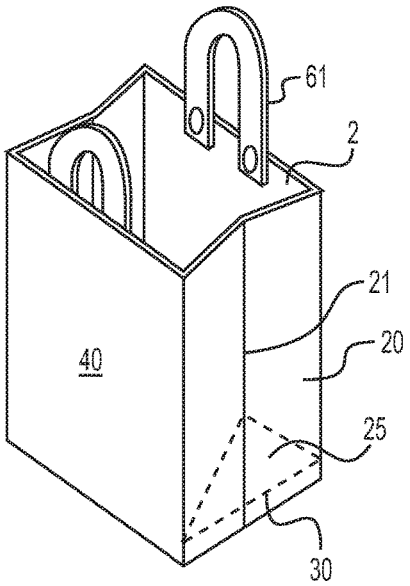
Figure 2C:
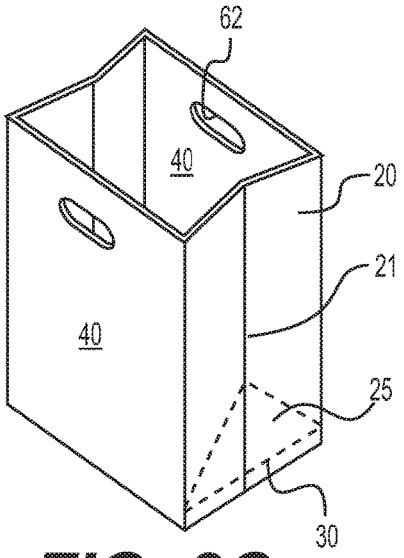

As shown in FIGS. 1C and 2B, bag 100 may comprise attached handles 61. Attached handles 61 may be secured to hem 50 is some embodiments, as depicted in FIG. 1C. Attached handles 61 may comprise the same material as plastic sheet 1 and may be formed of the same thickness as plastic sheet 1. For example, attached handles 61 may be comprise polyethelene, such as HDPE, LLDPE, LDPE or MDPE; other suitable plastics, or other flexible materials known in the art are contemplated. Here, attached handles 61 may be heat-sealed, respectively, to each of other sides 40 or, alternatively, to each of seamed sides 20. In alternative embodiments, attached handles 61 may be comprised of a rigid or semi-rigid plastic or other suitable material known in the art. In such embodiments, attached handles 61 may be connected to each of other sides 40 (as shown) or each of seamed sides 20, respectively, via a snapping mechanism, a looping mechanism, glue, or another mechanism known in the art.

As shown in the embodiments of FIGS. 1A-1C, each seamed side 20 may have a vertical seam 21 that extends from the top of the seamed side 20 to the location of a set of two flaps 25. In such embodiments, each bag 100 may comprise two sets of two flaps 25, thereby comprising four flaps 25. Each flap 25 may have the same shape. Vertical seam 21 may be centrally located in each of seamed sides 20. In some embodiments, for example as shown in FIG. 1A, some of the plastic sheet 1 may extend beyond the vertical seam 21. In other embodiments, for example, as shown in FIGS. 1B and 1C, the borders plastic sheet 1 end at the vertical seam 21.

In these embodiments, each flap 25 may comprise two layers of plastic sheet 1; may approximate a right triangle or a trapezoid with a right angle; and may be secured to a seamed side 20 by a horizontal flap seam 31, a diagonal flap seam 32, a differently oriented flap seam, or a combination thereof. Further, each flap 25 may extend from a seamed side 20, for example near the location of diagonal flap seam 32; and may include a fold at or near to the intersection of the seamed side 20 and an adjacent other side 40. Flaps 25 may be located on the inside of bag 100 and secured to the inner surface of a seamed side 20. However, in alternative embodiments, flaps 25 may be located on the outside of bag 100 and secured to the outer surface of a seamed side 20.

In some embodiments, as shown in FIGS. 1A-1C, for each seamed side 20, the diagonal edges of the two flaps 25 (which may be the hypotenuse where flap 25 approximates a right triangle), and the corresponding edge of the bottom 10 may define a triangular area of the seamed side 20. Vertical seam 20 may be absent from the triangular area, such that the triangular area may be seamless.

As shown in the alternative embodiments depicted in FIGS. 2A-2C, each of seamed sides 20 may have a vertical seam 21 that extends from the top of each seamed side 20 to the adjacent edge of bottom 10, and a set of one flap 25. In such embodiments, each bag 100 may comprise two sets of one triangular flap 25, thereby comprising two flaps 25. Each flap 25 may comprise two layers of plastic sheet 1, and may extend from an adjacent edge of bottom 10. Flap 25 may approximate a triangle or a trapezoid. Vertical seam 21 may be centrally located in each seamed side 20, may bisect flap 25, and may secure flap 25 to the seamed side 20. Specifically, vertical seam 21 may bind the outermost layer flap of 25 to seamed side 20.

In some embodiments, as shown in FIGS. 2B and 2C, each seamed side 20 may also have a side support flap seam 30. Side support flap seam 30 may be perpendicular to vertical seam 21; and may bind the innermost layer of flap 25, the outermost layer of flap 25, and sealed side 20 together. Use of side support flap seams 30 may facilitate self-supporting characteristics of bag 100, may improve the load capacity of bag 100, and may facilitate opening bag 100. In some embodiments, side support flap seam 30 may have a length that approximates a horizontally span across flap 25. Consequently, the length of side support flap seam 30 may ultimately define seamed side width 92.

Seam 30 and the adjacent edge of bottom 10 may be separated by a negligible distance such that they are virtually coextensive, may be separated by a distance of 0.2-2 cm, may be separated by a distance of 2-3.5 cm, or may be separated by a distance of 3.5-6 cm. The size of the distance may affect the dimensions of the bag. This is because for bag 100 made from a given plastic sheet 1, the length of side support flap seam 30 may vary with the distance. For example, the larger the distance is, the shorter the side support flap seam 30, and therefore the shorter seamed side width 92 and the longer other side width 93 may be.

It may further be noted that use of a side support flap seam 30 with an appreciable distance from an edge of bottom 10 may cause the carrying surface of bottom 10 to be curved. This is because on each of the sealed sides 20, the carrying surface of bottom 10 may extend from the side support flap seam 30, which may be disposed above the respective edges of bottom 10. Here, it may be expected that at least the central portion of the carrying surface of bottom 10 may rest upon the ground or the like.

Figure 5:
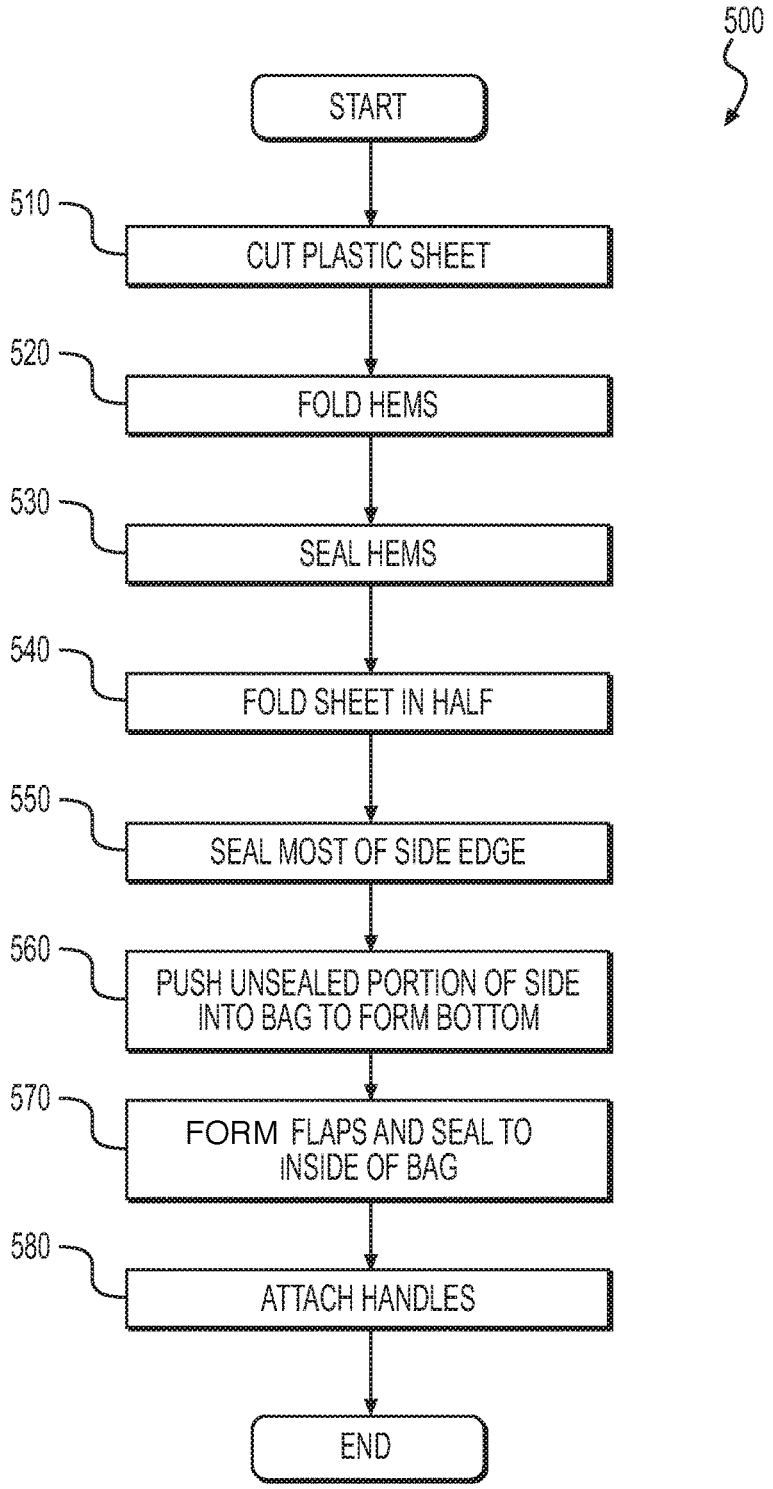
FIG. 5 is a flowchart of a method of manufacturing a self-supporting plastic bag, consistent with disclosed embodiments.

FIG. 5 is flowchart 500, which explains an embodiment of a method of manufacturing bags 100 similar to those depicted in FIGS. 1A-1C.

Figure 3A:
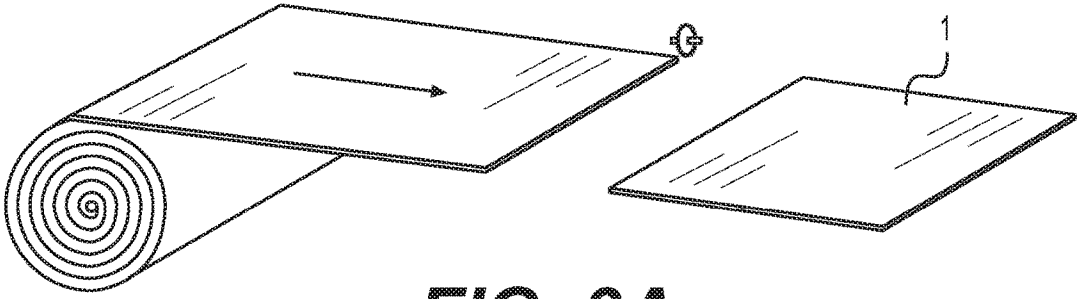
FIGS. 3A to 3G illustrate steps of a method of manufacturing a self-supporting plastic bag, consistent with disclosed embodiments.

As in step 510, and as illustrated in FIG. 3A, a plastic sheet 1 may be cut from a roll of plastic.

Figure 3B:
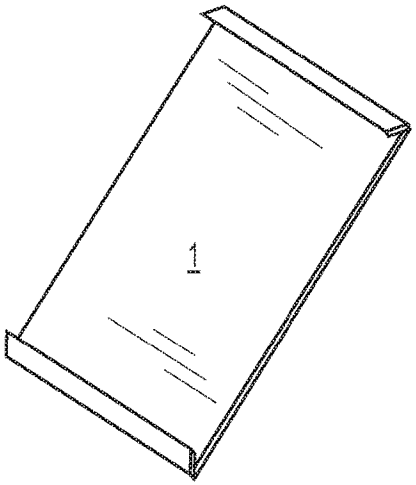
Figure 3C:
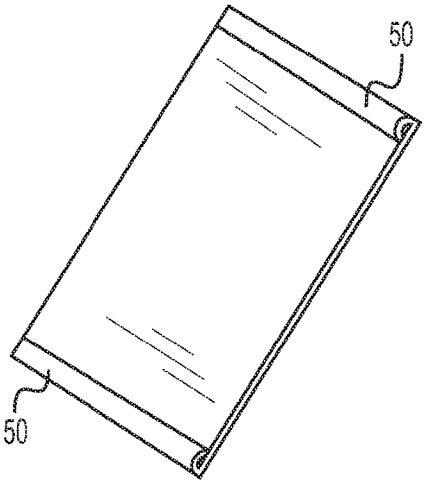
Figure 3E:
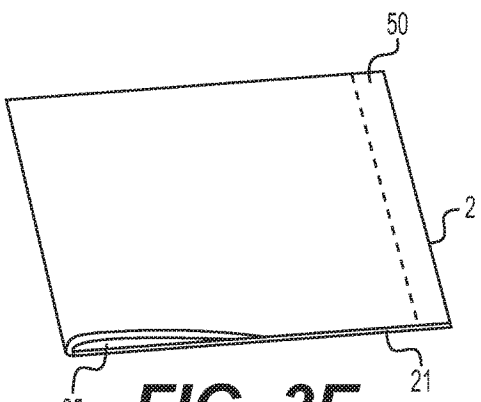

If hem 50 is to be included in bag 100, two hem portions at opposite ends of plastic sheet one are folded over as in step 520 and as illustrated in FIG. 3B. Then, the hem portions are sealed, as in step 530 and as illustrated in FIG. 3C. Seams may preferably be effectuated via hot heat sealing. In alternative embodiments, seams may be created by gluing, crimping, sewing, hot heat sealing, or a combination thereof.

Figure 3G:
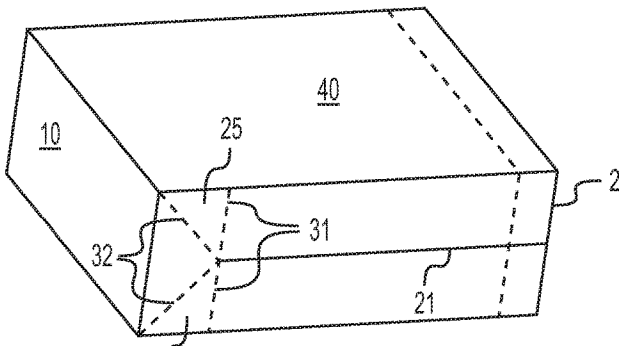
Figure 3D:
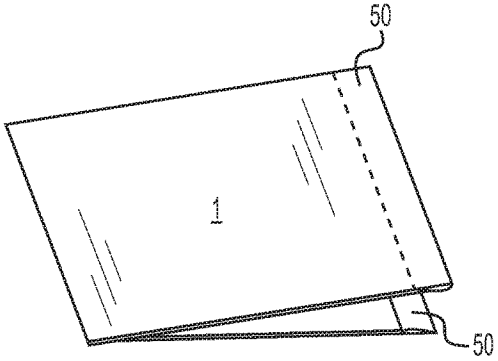

As in step 540, and as illustrated in FIG. 3D, plastic sheet 1 may be folded in half. Where a hem 50 is to be included, the hem components should be aligned with one another.

As in step 550, with the exception of a gap 35, the two edges of folded plastic sheet 1 may be seamed together to form vertical seal 21 on each side of bag 100.

Figure 3F:
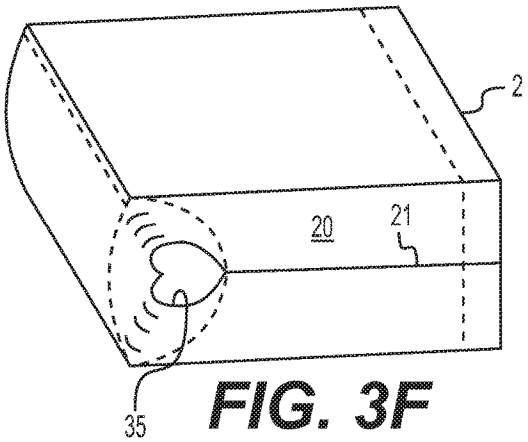

As in step 560 and as illustrated in FIG. 3F, the unsealed portion of the bag surrounding gap 35 may be pushed into the bag and the bag may take shape. This may be accomplished through the use of molds. The sides 20, 40 and bottom 10 may be partially formed and delineated by creases through the use of molds.

As in step 580 and as illustrated in FIG. 3G, the unsealed portion of the bag surrounding gap 35 may be may be molded and creased to form the set of flaps 25 and to further delineated the edges of bottom 10. This may be accomplished through the use of molds. Then, the seams 31, 32 may be added to secure flaps 25 to seamed side 20.

If a pair of handles is to be included in bag 100, as in step 580, cut handles 62 may be cut, punched, or sealed from bag 100. Alternatively, attached handles 61 may be heat sealed or otherwise attached to bag 100. In some embodiments, step 580 may occur earlier in the process, for example, after the plastic sheet is cut in step 510, or after the hem components are sealed in step 530.

Figure 6:
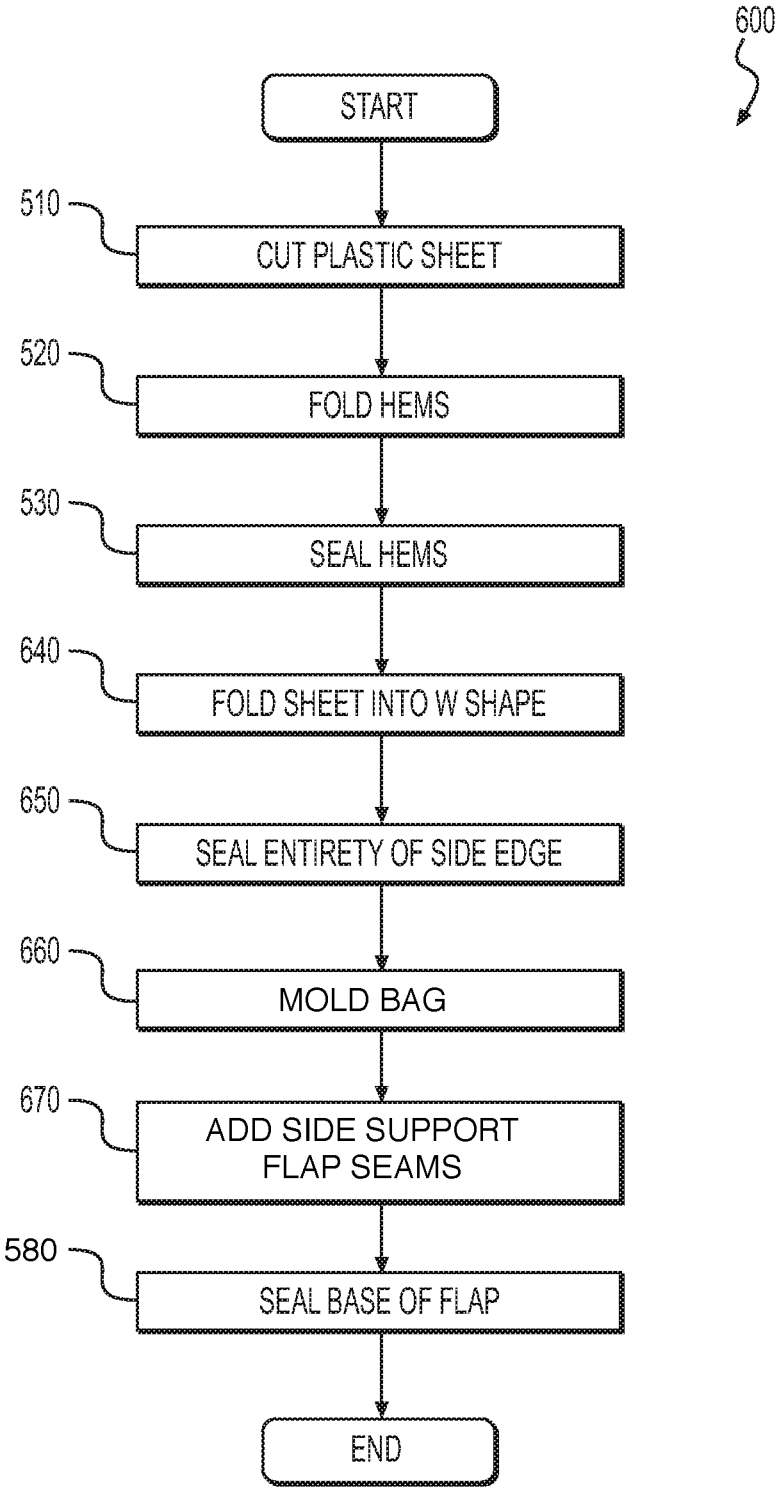
FIG. 6 is a flowchart of an alternative method of manufacturing a self-supporting plastic bag, consistent with disclosed embodiments.

FIG. 6 is flowchart 600, which explains an embodiment of a method of manufacturing bags 100 similar to those depicted in FIGS. 2A-2C.

Step 510 and option steps 520 and 530 may proceed as described with respect to flow chart 500.

Figure 4B:
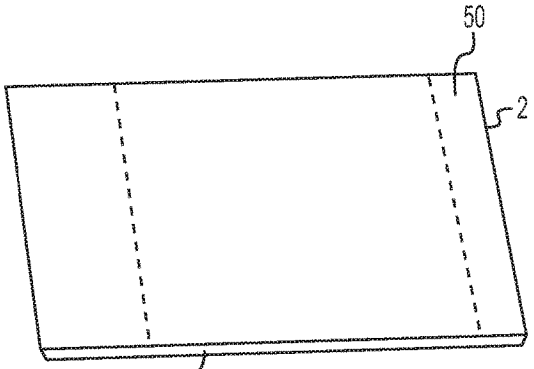
FIGS. 4A to 4D illustrates steps of an alternative method of manufacturing a self-supporting plastic bag, consistent with disclosed embodiments.
Figure 4D:
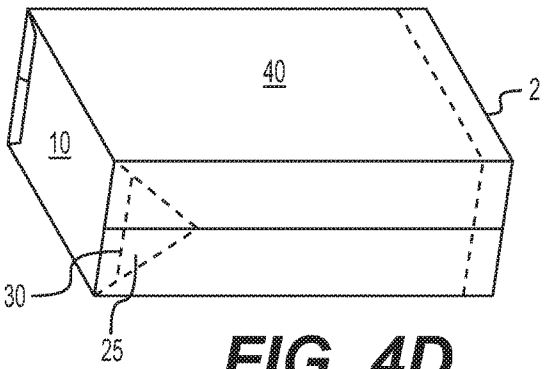
Figure 4A:
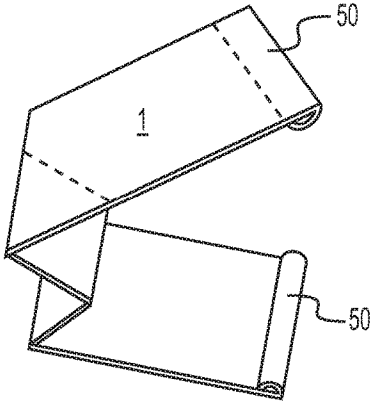

As in step 640, and as illustrated in FIG. 4A, plastic sheet 1 may be folded so that its cross-section resembles a "W" shape. Where a hem 50 is to be included, the hem components should be aligned with one another.

As in step 650, and as illustrated in FIG. 4B, the two edges of folded plastic sheet 1 may be seamed together to form vertical seal 21 on each side of bag 100.

Figure 4C:
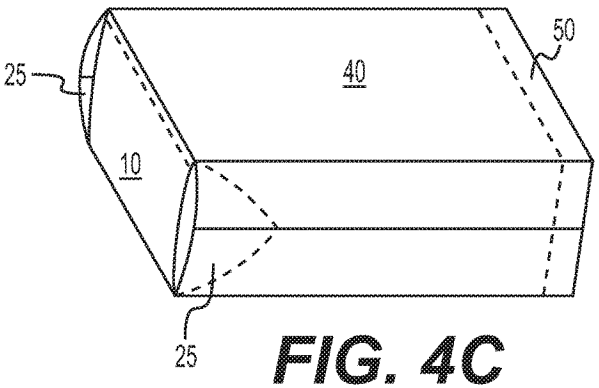

As in step 660 and as illustrated in FIG. 4C, the seamed plastic sheet 1 may be formed into a bag shape. Ultimately, the bottom 10 and flaps 20 may be formed by manipulating the shorter, middle two sections of the folded and seamed "W." The sides 20, 40, flaps 25, and bottom 10 may be formed and delineated by creases through the use of molds. Step 660, however, may be omitted where unmolded bags may be desired for reduced volume in shipping, packing, or the like.

Optionally, as in step 670 and as illustrated in FIG. 4D, side support flap seams 30 may be added, thereby providing bag 100 with additional structure.

Step 580 may optionally proceed as described with respect to flow chart 500.

Although the foregoing embodiments have been described in detail by way of illustration and example for purposes of clarity of understanding, it will be readily apparent to those of ordinary skill in the art in light of the description herein that certain changes and modifications may be made thereto without departing from the spirit or scope of the appended claims. It is also to be understood that the terminology used herein is for the purpose of describing particular aspects only, and is not intended to be limiting, since the scope of the present invention will be limited only by the appended claims.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation. As will be apparent to those of ordinary skill in the art upon reading this disclosure, each of the individual aspects described and illustrated herein has discrete components and features which may be readily separated from or combined with the features of any of the other several aspects without departing from the scope or spirit of the disclosure. Any recited method can be carried out in the order of events recited or in any other order that is logically possible. Accordingly, the preceding merely provides illustrative examples. It will be appreciated that those of ordinary skill in the art will be able to devise various arrangements which, although not explicitly described or shown herein, embody the principles of the disclosure and are included within its spirit and scope.

Furthermore, all examples and conditional language recited herein are principally intended to aid the reader in understanding the principles of the invention and the concepts contributed by the inventors to furthering the art, and are to be construed without limitation to such specifically recited examples and conditions. Moreover, all statements herein reciting principles and aspects of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary configurations shown and described herein.

In this specification, various preferred embodiments have been described with reference to the accompanying drawings. It will be apparent, however, that various other modifications and changes may be made thereto and additional embodiments may be implemented without departing from the broader scope of the claims that follow. The specification and drawings are accordingly to be regarded in an illustrative rather than restrictive sense.

We claim:

1. A plastic bag, the bag comprising:

a rectangular bottom with first, second, third, and fourth edges;

a first side extending from a first edge of the bottom, the first side having a first vertical seam and a first flap set;

a second side extending from a second edge of the bottom;

a third side extending from a third edge of the bottom, the third side having a second vertical seam and a second flap set;

a fourth side extending from a fourth edge of the bottom; and a first horizontal flap seam disposed on the first side parallel to the first edge of the bottom, wherein:

the bottom, the first side, the second side, the third side, and fourth side are integrally formed from a single sheet of a plastic material;

the first flap set comprises a first triangular flap and a second triangular flap;

one side of the first triangular flap extends from a linear intersection of the first side and the second side;

the first triangular flap is secured to the first side by the first horizontal flap seam and a first diagonal flap seam;

one side of the second triangular flap extends a linear intersection of the first side and the fourth side; and the second triangular flap is secured to the first side by the first horizontal flap seam and a second diagonal flap seam.

2. The bag of claim 1, wherein:

the first side is parallel to and the same size as the third side;

the second side is parallel to and the same size as the fourth side;

the first side connects with and is perpendicular to both the second side and the fourth side.

3. The bag of claim 2, wherein the bag is self-supporting when open.

4. The bag of claim 3, wherein:

the first flap comprises two layers of the single sheet, the first flap extending from the first side and second side, respectively; and the second flap comprises two layers of the single sheet, the second flap extending from the first side and fourth side, respectively.

5. The bag of claim 4, wherein:

the first vertical seam extends from the top of the first side to the first horizontal flap seam.

6. The bag of claim 3, wherein a width of the first side is shorter than a width of the second side.

7. The bag of claim 2, wherein:

the second side does not have a seam;

the fourth side does not have a seam;

the bottom does not have a seam along any of its edges.

8. The bag of claim 2, further comprising a pair of handles.

9. The bag of claim 2, further comprising:

a pair of handles and a hem at the top of the bag, wherein the pair of handles comprises strips of plastic attached to the hem.

10. The bag of claim 1, further comprising:

a second horizontal flap seam disposed on the third side parallel to the third edge of the bottom, wherein:

the second flap set comprises a third triangular flap and a fourth triangular flap;

one side of the third triangular flap extends from a linear intersection of the third side and the second side;

the third triangular flap is secured to the third side by the second horizontal flap seam and a third diagonal flap seam;

one side of the fourth triangular flap extends from a linear intersection of the third side and the fourth side; and the fourth triangular flap is secured to the third side by the second horizontal flap seam and a fourth diagonal flap seam.

11. The bag of claim 10, wherein:

the third flap comprises two layers of the single sheet, the third flap extending from the third side and second side, respectively; and the fourth flap comprises two layers of the single sheet, the fourth flap extending from the third side and fourth side, respectively.

12. The bag of claim 10, wherein:

the first vertical seam extends from the top of the first side to the first horizontal flap seam; and the second vertical seam extends from a top of the third side to the third horizontal flap seam.

13. The bag of claim 10, wherein:

the first flap, the second flap, the third flap, and the fourth flap are shaped as right triangles.

14. The bag of claim 10, wherein:

the first horizontal flap seam, the second horizontal flap seam, the first diagonal flap seam, the second diagonal flap seam, the third diagonal flap seam, and the fourth diagonal flap seam are hot heat seals.

15. The bag of claim 10, wherein:

the first diagonal seam, the second diagonal seam, and the first edge of the bottom encircle a triangular area of the first side;

the triangular area of the first side is seamless;

the third diagonal seam, the fourth diagonal seam, and the third edge of the bottom encircle a triangular area of the third side; and the triangular area of the third side is seamless.

16. The bag of claim 10, wherein:

the first flap, the second flap, the third flap, and the fourth flap are disposed on the inside of the bag.

17. The bag of claim 10, wherein:

the first flap, the second flap, the third flap, and the fourth flap are disposed on the outside of the bag.

18. The bag of claim 1, wherein:

the first flap and the second flap are shaped as right triangles.

19. The bag of claim 1, wherein:

the first horizontal flap seam, the first diagonal flap seam, and the second diagonal flap seam are hot heat seals.

20. The bag of claim 1, wherein:

the first diagonal seam, the second diagonal seam, and the first edge of the bottom encircle a triangular area of the first side; and the triangular area of the first side is seamless.

21. The bag of claim 1, wherein:

the first flap and the second flap are disposed on the inside of the bag.

22. The bag of claim 1, wherein:

the first flap and the second flap are disposed on the outside of the first side.

* * * * *